United States Patent [19]

Jacques

[11] 4,093,212

[45] June 6, 1978

[54] PUNCHING BAG FOR PRACTICING UPPERCUTS

[76] Inventor: Ronald Harmon Jacques, 15 E. Bunns La., Woodbridge, N.J. 07095

[21] Appl. No.: 685,630

[22] Filed: May 12, 1976

[51] Int. Cl.[2] ..... A63B 69/00

[52] U.S. Cl. ..... 272/76; 272/136; 272/DIG. 4

[58] Field of Search ..... 272/66, 76, 77, 78, 272/136, 55, DIG. 4

[56] References Cited

U.S. PATENT DOCUMENTS

| | | | |
|---|---|---|---|
| 931,818 | 8/1909 | Valentine | 272/76 |
| 1,222,924 | 4/1917 | Boyd | 272/76 |
| 2,109,551 | 3/1938 | Sacher | 272/76 X |
| 2,509,796 | 5/1950 | Bailey | 272/55 |
| 3,421,760 | 1/1969 | Freeman | 272/136 X |
| 3,927,879 | 12/1975 | Long et al. | 272/76 |

*Primary Examiner*—George J. Marlo

*Attorney, Agent, or Firm*—Kenyon & Kenyon, Reilly, Carr & Chapin

[57] ABSTRACT

A punching bag useful in training fighters in developing an effective uppercut includes a vertical member for attachment to the wall having disposed rotatably thereon a horizontal bar containing on its end a padded arm terminating in a rounded portion which simulates the chin of a fighter. The horizontal arm is limited in its downward travel by a hard rubber stop and is biased to the horizontal position by a heavy tension spring but is free to rotate upward against the tension of the spring allowing the training fighter to practice uppercuts on the end thereof and develop the necessary muscles required for such a punch.

10 Claims, 3 Drawing Figures

PUNCHING BAG FOR PRACTICING UPPERCUTS

BACKGROUND OF THE INVENTION

This invention relates to training equipment in general and more particularly to an improved punching bag type device for training fighters to develop an effective uppercut.

Presently used punching bags for training fighters generally take two forms. One is a light bag mounted in a springy manner which permits the fighter to effectively practice jabbing. The other type is a heavy bag which is used for developing the fighters punching strength. Although such bags have been in use for many years and have been found to be effective training devices they are lacking in one significant respect. None of these bags have the capability of properly training the fighter. to develop an effective uppercut. On none of them can he practice the uppercut which is directed toward the opponents chin and is a very important punch resulting in many knockouts. Consequently the only practice the fighter gets in this punch is during sparing. Because of the limited practice with this punch the fighter does not develop the necessary muscles required for carrying out an effective uppercut.

Thus, the need for an improved punching bag or training device which will permit a fighter to develop his uppercut becomes evident.

SUMMARY OF THE INVENTION

The present invention provides such a training device or punching bag. A padded arm is disposed on the end of a horizontal bar which is rotatably mounted to a vertical member which may be bolted to the wall in the gym. Downward motion of the horizontal bar with the padded arm thereon is limited by a hard rubber stop. The padded arm is biased against the stop i.e. to essentially a horizontal position by means of a heavy tension spring. The end of the padded arm is rounded to essentially simulate the chin of the oponent thereby permitting the training fighter to practice uppercuts using the padded arm, the fighters uppercut in effect driving the arm in an arcuate path upward much in the way that similar punch would drive the chin of an opponent upward.

DETAILED DESCRIPTION OF THE PREFERRED EMBODIMENT

Figure 1:
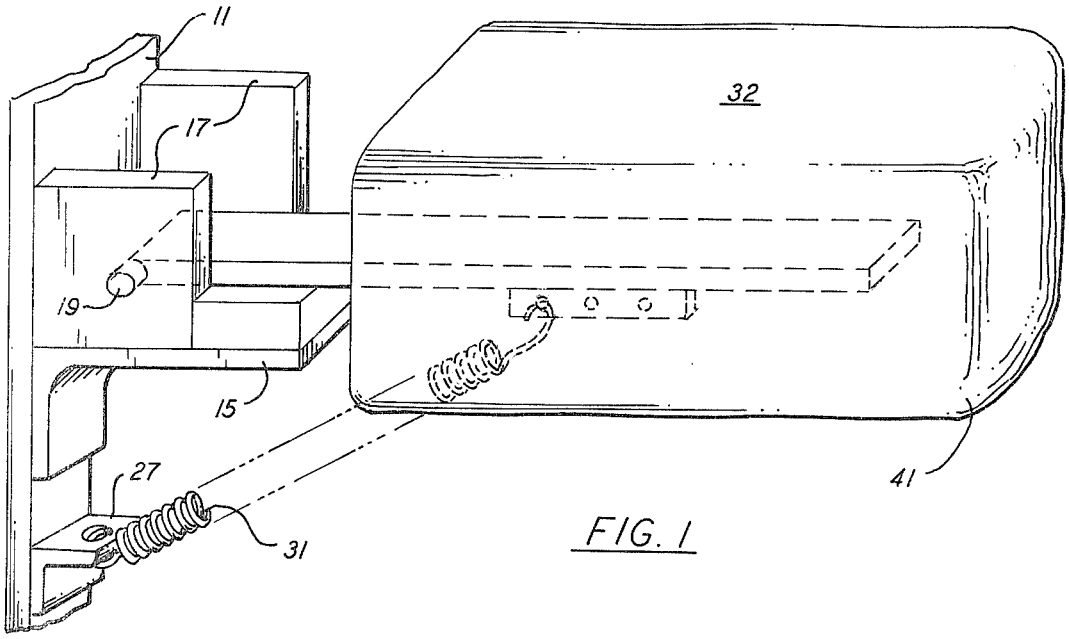
FIG. 1 is a perspective view of the training device of the present invention.
Figure 2:
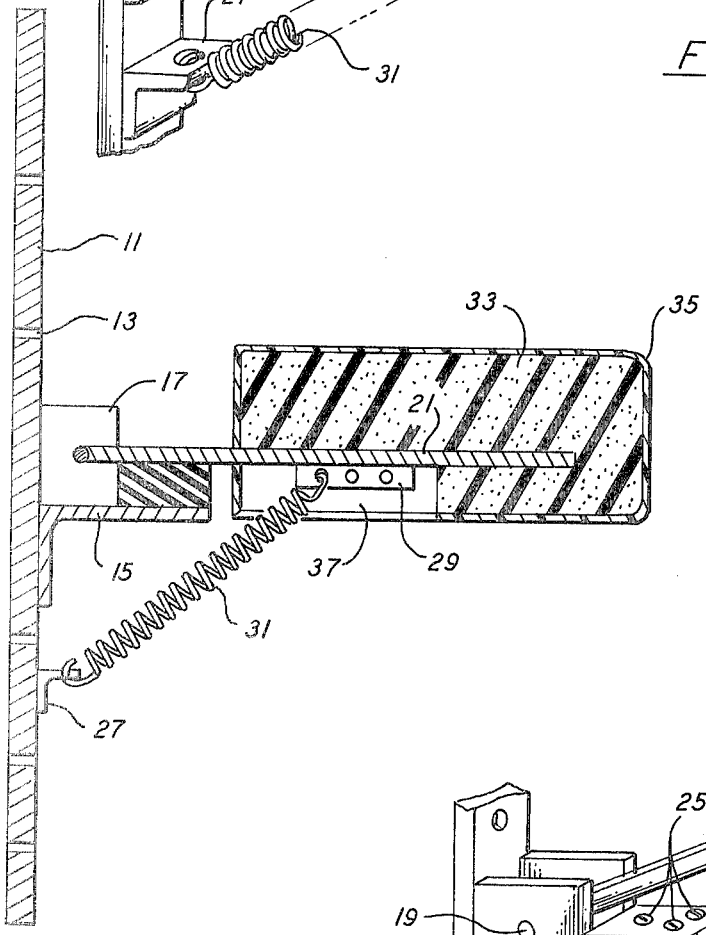
FIG. 2 is an elevation view of the device showing the padded arm cut away to illustrate the inner bar and attachment of the spring.
Figure 3:
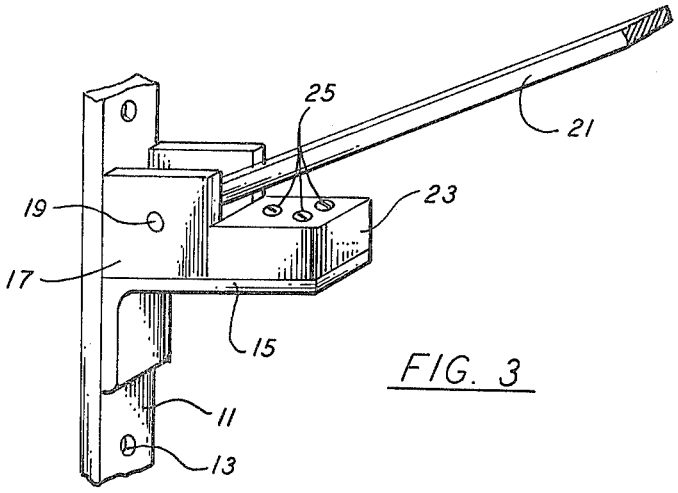
FIG. 3 is a perspective view of the device of FIG. 1 with the horizontal bar raised showing further details of construction.

FIGS. 1 through 3 illustrate a training device according to the present invention. As illustrated the device includes a vertical bar 11 containing a plurality of bolt holes 13 to permit it to be bolted to the wall in the gym or other location where it is to be used. Attached at approximately the middle of the bar 13, preferrably by welding, is an angle bracket 15. Welded to the vertical bar 11 and to the angle bracket 15 are pair of side plates 17. These each contain a central hole and have disposed, for rotating therein a rod 19 which is welded to the end of a horizontal bar 21. The holes are approximately at the center of the members 17. Disposed on the bottom of the angle bracket 15 is a stop 23 made of hard rubber. Typically, the hard rubber stop may be bolted in place using bolts 25 passing through suitable holes in the hard rubber member and in the horizontal portion of the angle bracket 15. A smaller angle bracket 27 is attached to the vertical bar 13 below the angle bracket 15. This angle bracket 27 contains a hole in its horizontal portion. Welded to the bottom of the horizontal bar 21 is a vertical member 29 containing a plurality of holes, three in the example. Extending between the angle bracket 27 and the member 29, with its ends engaging in the respective holes therein is a heavy tension spring 31. The plurality of holes in the member 29 permit adjusting the tension of this spring. Glued to the horizontal bar 21 is padding 33 of the general type used in heavy punching bags. This will be a relatively hard material although some heavier forms of foam rubber or foam plastic can be used for this purpose. After gluing the padding 23 in place it is covered with an outer cover of leather or vinyl 35. A suitable opening 37 is left to permit engagement of the end of the spring 31 with the member 29.

When installed, the vertical rod 13 is bolted to the wall such that the end or edge 41 of the padded arm will be approximately at the height of a man's chin. The training fighter can then practice uppercuts by punching the end 41 of the padded arm. He will be working against the force of the spring 31 and, as noted above, can adjust the tension accordingly. Of course, it is also possible to practice other types of punching against the sides or front of the padded arm. With this device, training of the fighter is given an added dimension permitting him to develop the muscles necessary to carry out effective uppercut punching.

Typical dimensions and materials which can be used other than those mentioned above will now be described. In an embodiment of this device which has been tested, the vertical member 11 and horizontal member 21 were both made of $\frac{3}{8}$ inch strap iron 3 inches wide. The vertical member had a length of 36 inches and the horizontal member a length, as measured from the wall, of 19 inches. The angle bracket 15 had a vertical dimension of $4\frac{1}{2}$ inches and a horizontal dimension of $5\frac{1}{2}$ inches. The hard rubber stop 25 measured approximately $3 \times 3\frac{1}{2}$ inches with the side pieces 17 having dimensions of $3 \times 3$ inches. These also were made of $\frac{3}{8}$ inch strap iron. In the tested embodiment the rod 19 was a $\frac{3}{8}$ inch bolt welded to the arm 21. It will be recognized that $\frac{3}{8}$ inch steel rod can equally well be used. The spring 31 was a 6 inch by 2 inch coiled tension spring made of $\frac{1}{4}$ inch spring wire. The padded arm had a length of approximately $14\frac{1}{2}$ inches, a height of 5 inches and a width of 7 inches.

Thus an improved training device for use by fighters which permits training in upper cut punches, of which training was previously not available other than in the ring has been shown. Although a specific embodiment has been illustrated and described, it will be obvious to those skilled in the art that various modifications may be made. For example, rather than using a vertical bar, a circular vertical member could be provided containing the necessary attachment means for the horizontal arm, said circular vertical member then bolted to the wall. These and other modifications can be made without departing from the spirit of invention which is intended to be limited solely by the appended claims.

What is claimed is:

1. A training device for fighters permitting the practice of uppercut punches comprising:

a. a mounting member for attachment to the wall of a room in which training is to take place said member arranged to be vertically disposed thereon;

b. an arm having padding attached on all sides thereof and presenting at its outer end a portion simulating the chin of a fighter;

c. an angle bracket rigidly attached to said mounting member;

d. first and second side members rigidly attached to said mounting member and to said angle bracket said side members each having a hole formed therein; and e. a rod rigidly attached to the end of said arm disposed in said holes for rotation therein;

f. means for limiting the downard motion of said padded arm to an approximately horizontal position such that the bottom portion of the padding on the end of said arm, when said mounting member is attached to the wall, will be approximately at the height of a man's chin; and g. means biasing said padded arm downward to said approximately horizontal position.

2. Apparatus according to claim 1 wherein said member for attachment to a wall comprises a vertical bar having a plurality of holes formed therein to permit bolting to the wall.

3. Apparatus according to claim 1 wherein said padded arm comprises a horizontal metal bar having padding attached on all sides thereof.

4. Apparatus according to claim 3 and further including an outer cover surrounding said padding.

5. Apparatus according to claim 4 wherein said outer cover is made of leather.

6. Apparatus according to claim 4 wherein said outer cover is made of vinyl.

7. Apparatus according to claim 1 wherein said angle bracket is attached to said vertical bar by welding, said side members attached to said vertical bar and said angle bracket by welding, and said rod on the end of said horizontal arm attached thereto by welding.

8. Apparatus according to claim 7 wherein said means for limiting motion to an essentially horizontal position comprise a hard rubber block secured to the end of said angle bracket.

9. Apparatus according to claim 8 wherein said biasing means comprise:

a. first attachment means disposed on said mounting member below said angle bracket;

b. second attachment means disposed on the horizontal arm; and c. a tension spring having its ends attached to said first and second attachment means biasing said horizontal bar downward against said hard rubber stop.

10. Apparatus according to claim 9 wherein at least one of said attachment means includes a plurality of attachment points whereby the tension of said spring can be adjusted.

* * * * *